United States Patent [19]

Christiansen

[11] Patent Number: 4,763,810

[45] Date of Patent: Aug. 16, 1988

[54] MEDICATION DISPENSER

[76] Inventor: Lee T. Christiansen, 2245 Franklin Ave., Meeteetse, Wyo. 82433

[21] Appl. No.: 943,738

[22] Filed: Dec. 19, 1986

[51] Int. Cl.[4] ..... B65D 83/04

[52] U.S. Cl. ..... 221/3; 221/5; 221/15; 221/91

[58] Field of Search ..... 221/2, 3, 5, 12, 15, 221/25, 89, 91; 206/534, 538

[56] References Cited

U.S. PATENT DOCUMENTS

| | | | |
|---|---|---|---|
| 520,243 | 5/1894 | Randall | 221/91 X |
| 3,876,269 | 4/1975 | Fisher et al. | 312/234.1 |
| 3,911,856 | 10/1975 | Ewing | 206/534 X |
| 3,921,806 | 11/1975 | Wawracz | 206/534 |
| 4,038,937 | 8/1977 | Moe | 206/538 X |
| 4,126,247 | 11/1978 | Majka | 221/91 X |
| 4,223,801 | 9/1980 | Carlson | 221/3 |
| 4,572,403 | 2/1986 | Benaroya | 221/15 X |
| 4,573,606 | 3/1986 | Lewis et al. | 221/2 |
| 4,626,105 | 12/1986 | Miller | 221/2 X |
| 4,663,621 | 5/1987 | Field et al. | 221/2 X |

FOREIGN PATENT DOCUMENTS

| | | | |
|---|---|---|---|
| 2099803 | 12/1982 | United Kingdom | 221/15 |

*Primary Examiner*—F. J. Bartuska

*Attorney, Agent, or Firm*—Henderson & Sturm

[57] ABSTRACT

A tamper-proof apparatus of a type for automatically dispensing medication having a housing with a plurality of medication holding compartments each having an open bottom therein. The compartments can either be of a type which are open at the top so they can be filled manually, or they can be of a prepackaged type having a closed top and a slide-open bottom which are available from and returnable for refilling to a pharmacy. A belt is disposed under the medication holding compartments and the belt has at least one opening therein. A microprocessor is used to control a motor or the like for selectively advancing the belt so that the opening therein moves from beneath one compartment to a position beneath another compartment whereby when the opening moves below a particular compartment, pills contained in such particular compartment will drop down through the openings. The microprocessor can be programmed by authorized personnel to dispense medication from any one of the compartments at any one time. It can be programmed for any particular length of time, being limited only by the number of pill holding compartments and such number can be large to accommodate almost any need. A lid having a lock thereon can be controlled by the microprocessor to allow access only to persons knowing a certain code.

22 Claims, 4 Drawing Sheets

8. 8.

MEDICATION DISPENSER

TECHNICAL FIELD

The present invention relates generally to a medication dispensing apparatus, and more particularly to one that is tamper-proof, is microprocessor controlled, and dispenses medication for a plurality of days, as well as at a plurality of times per day.

BACKGROUND ART

In the dispensing of medication, there is a universally recognized problem of getting the prescribed amount of medication to the patient at the prescribed times. If the medication is taken at the wrong times, or is not taken at all, or is taken in an improper dosage, the medication will not function in the manner prescribed by the physician and can therefore be dangerous and perhaps even fatal, if not accurately controlled. This responsibility can be difficult to control for people since they get involved in their everyday lives and quite often forget to take or give to persons under their charge, the medication at the proper times. This can particularly be a problem for elderly people whose memory is not what it once was.

Some people working in the geriatrics field have been quoted as saying that many elderly people could be kept out of retirement homes or rest homes for as much as five or six years or more, if the medication of such elderly persons could be controlled accurately at their home. Obviously, someone, either a professional or the children of such elderly people, must take the responsibility for giving the medication at the proper time, (often three or four times per day) and in a proper dosage for such persons. It is not uncommon that some individuals on medication regularly coax, threaten or coerce professional staff or family to give them the medication before the proper time. If such medication is being dispensed by a machine, then the patient can only blame the machine and not the person responsible for giving them the medication, thereby easing tensions, and ultimately this would be for their better health since medication was taken as prescribed.

Medication, particularly antibiotics, would be of much greater benefit to children or other convalescing persons, if they are taken at the prescribed regular intervals and if the total prescription were to be taken. Typically, the actual times for a desired four-hour interval ranges from two to eight hours and then, as the patient begins to feel better, the medication is not taken at all, leaving potentially harmful pills in a medicine chest or the like. Often times the patient then relapses, since all of the medicine was not taken. Consequently, there is a need to provide an apparatus to prevent this situation.

In addition to the need for being able to control the dosage of medication and the time for taking such medication, there is also the problem of limiting access of the medication from an aged person who cannot be trusted to take only that which has been prescribed. Elderly people often take all the pills for a given day in existing pill holders at one time, even though the medication was to be taken at three or four different times. For a child too young to know the difference or staff working at a hospital who may desire to use the drugs for illicit purposes, access should be prevented. The prior art solutions to the aforementioned problems are shown generally by U.S. Pat. Nos. 3,876,629 to Fisher et al.; 3,911,856 to Ewing; 3,921,806 to Wawracz; 4,223,801 to Carlson; and 4,573,606 to Lewis et al. All of the aforementioned prior art patents use a disc or cylinder having compartments therein and then rotating such cylinder to feed the medication through an opening. Generally, this category of dispensers are limited because they are either manually operated or they will have only a limited number of storage compartments, thus they can only dispense for short periods of time. Furthermore, they are not tamper-proof or pilfer-proof as a general rule.

DISCLOSURE OF THE INVENTION

The present invention relates to a tamper-proof apparatus of a type for automatically dispensing medication having a housing with a plurality of medication holding compartments each having an open bottom therein. The compartments can either be of a type which are open at the top so they can be filled manually, or they can be of a prepackaged type having a closed top and an slide-open bottom which are available from a pharmacy. A belt is disposed under the medication holding compartments and the belt has at least one opening therein. A microprocessor is used to control a motor or the like for selectively advancing the belt so that the opening therein moves from beneath one compartment to a position beneath another compartment whereby when the opening moves below a particular compartment, pills contained in such particular compartment will drop down through the opening. The microprocessor can be programmed by authorized personnel to dispense medication from any one of the compartments at any one time. It can be programmed for any particular length of time, being limited only by the number of pill holding compartments and such number can be large to accommodate almost any need. A lid having a lock thereon can be controlled by the microprocessor to allow access only to authorized persons knowing a certain code. Similarly, a pill drawer for receiving pills dropping through the opening in the belt, has a lock thereon and can be, if unauthorized pill pilferring could be a problem, opened only by persons knowing a single or larger digit code which must be punched into the microprocessor before the drawer can be opened.

An object of the present invention is to provide an improved apparatus for automatically dispensing medication.

Another object of the present invention is to provide an automatic medication dispensing apparatus which is programmable for long periods of time.

A further object of the present invention is to provide an automatic medication dispensing apparatus which is essentially tamper-proof from unauthorized personnel.

A still further object of the present invention is to provide an automatic medication dispenser which can use prepackaged or pharmacist refilled prescription medicines or which can utilize a pill compartment device which can be filled manually by authorized personnel.

A further object of the present invention is to provide an apparatus of the aforementioned type which is tamper-proof from unauthorized persons gaining access to the medication therein.

A still further object of the present invention is to provide an apparatus of the aforementioned type which has an audio alarm and a visual light for indicating when the medication is being dispensed.

A still further object of the present invention is to provide a way whereby the family or others in charge of dispensing needed medication to the elderly one, two, three, four or more times per day need not actually be present every hour a pill is to be taken to supervise the taking of said medication by normal, but perhaps forgetful elderly persons.

A still further object of the invention is to provide a medication-taker safe, long term independence from a responsible medication-giver and provide the responsible medication-giver safe, long term independence from the medication-taker.

Other objects, advantages, and novel features of the present invention will become apparent from the following detailed description of the invention when considered in conjunction with the accompanying drawings.

BEST MODE FOR CARRYING OUT THE INVENTION

Figure 1:
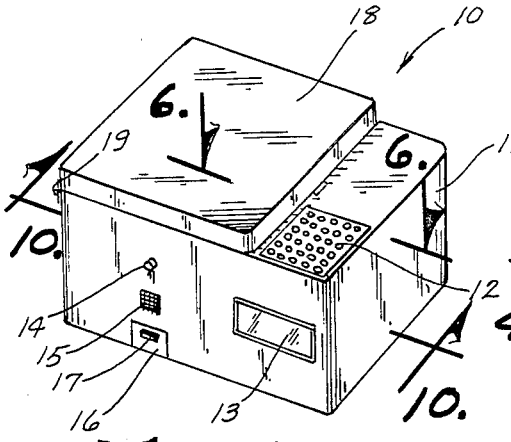
FIG. 1 is a perspective view of a preferred embodiment constructed in accordance with the present invention.

Referring now to the drawings, wherein like reference numerals designate identical or corresponding parts throughout the several views, FIG. 1 shows a medication dispensing apparatus (10) constructed in accordance with the present invention. The apparatus (10) includes a housing (11) having a microprocessor (12) thereon and a digital read-out section (13) for the microprocessor (12). A flashing light (14) and an audio alarm (15) are connected to the microprocessor (12) and are attached to the housing above a drawer (16) having a handle (17) thereon. A lid (18) is pivotally attached by a hinge (19) to the housing (11).

Figure 3:
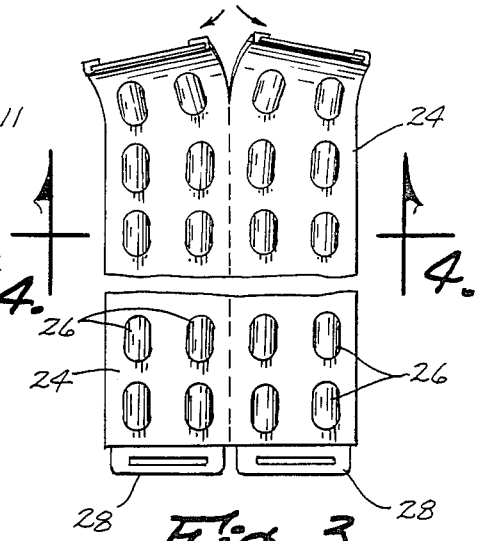
FIG. 3 is a top view of a prepackaged pill holder showing how adjacent strips can be torn apart if necessary.
Figure 2:
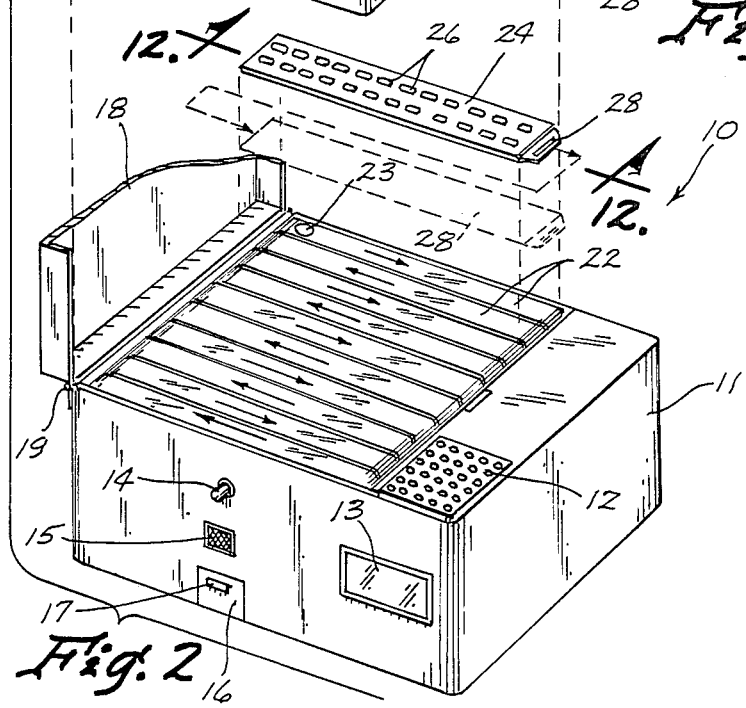
FIG. 2 is an exploded view showing the lid open and optional prepackaged pill holders or, alternatively, a tube dispenser which can be manually filled.

Referring to FIG. 2 it is noted that a tube dispenser (21) having 120 compartments which are open at the top and the bottom thereof and which are evenly spaced around the tube dispenser (21) can be placed on an endless belt (22) kept in place by supporting means (55) having an opening (23) therein for reasons which will be explained below. Alternatively, a prepackaged pill dispenser (24) be available from the manufacturer or from a pharmacist which has a number of bubbles or raised compartments (26) for holding one or more pills (27) in each compartment. A cardboard or plastic slide (28) holds the pills (27) in place while the prepackaged medication holder (24) is placed on the belts (22), for example as shown in FIG. 2 either in one strip, as shown in FIG. 2, or in multiple strips, for example as shown in FIG. 3. These prepackaged strips (24) can be held in place by tapered pins (not shown) extending through openings in (24) or the like (also not shown) or they can just be held in place by the lid (18) holding them down from the top thereof. When the prepackaged medication (24) is used, it is placed onto the belt (22) in a predetermined place and then the cardboard or plastic slide (28) is pulled out from under the bottom of the compartments (26) so that the pills (27) will rest on the endless belt (22). It is also to be understood that there can be enough of the prepackaged medication holders (24) so as to cover the entire belt (22), which would include at least 120 pill holding compartments (26). Of course, if someone wished to have an apparatus which included more or less than 120 pill holding compartments, it would still be within the scope and spirit of the present invention.

The major difference between the pill holding devices (24) and the tube dispenser (21) is that the devices (24) would be packaged by the manufacturer and taken back to a pharmacist for refilling and to that extent might be more reliable and more convenient to use, whereas, the tube dispenser (21) can be loaded manually and, while not necessarily as convenient, can be more versatile; for example, if the physician added an additional medication, the lid (18) could be opened by an authorized person and such additional medication could be dropped into the appropriate openings therein as desired.

Figure 5:
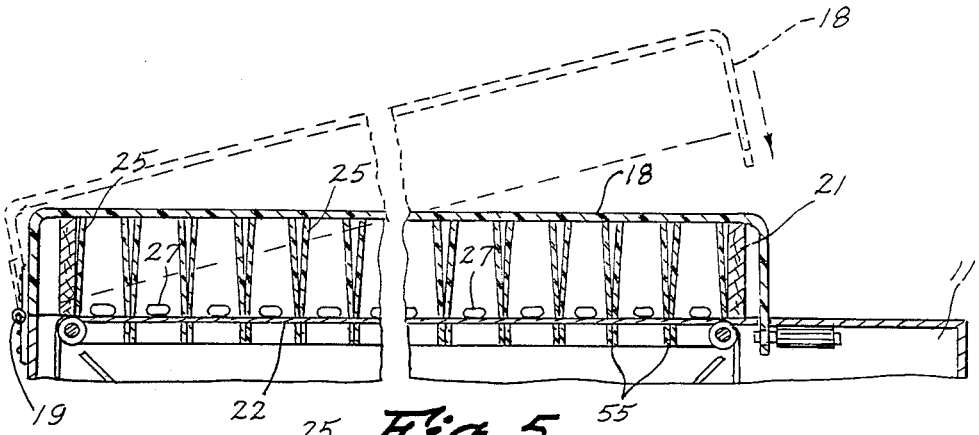
FIG. 5 is a cross sectional view taken along line 5—5 of FIG. 2 and showing how the manually loaded tube dispenser is constructed.
Figure 6:
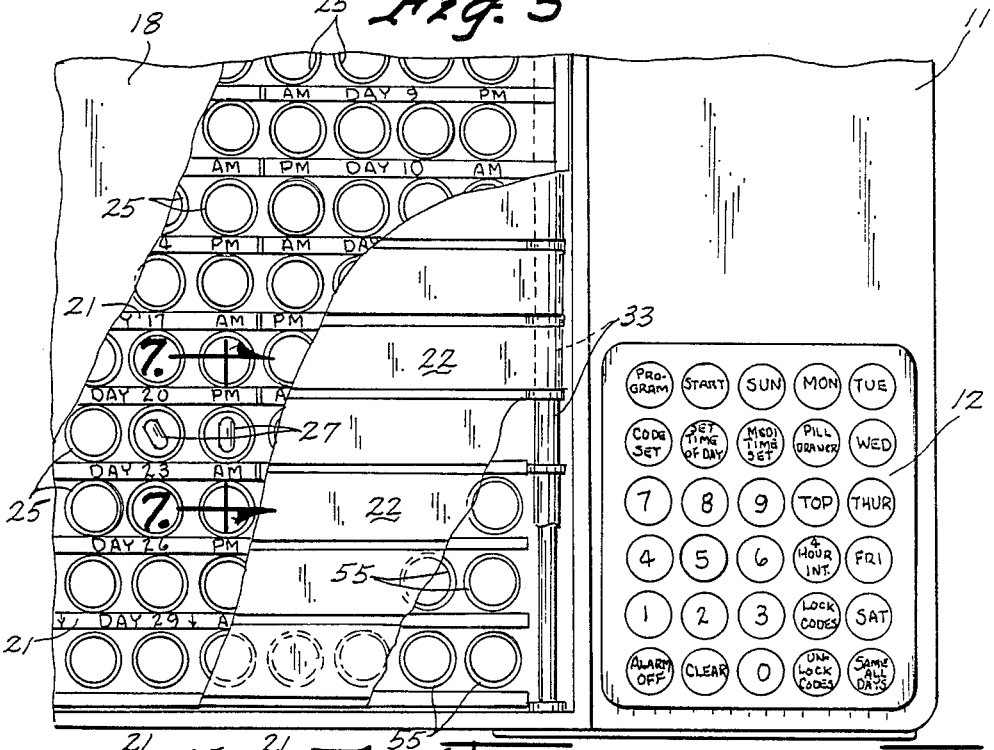
FIG. 6 is an enlarged top view of the preferred embodiment having certain portions cut away to show other layers below and showing the control panel of the microprocessor.
Figure 7:
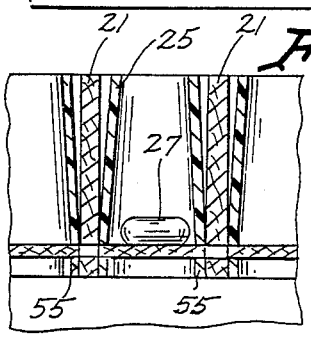
FIG. 7 is an enlarged cross sectional view taken along line 7—7 of FIG. 6.
Figure 8:
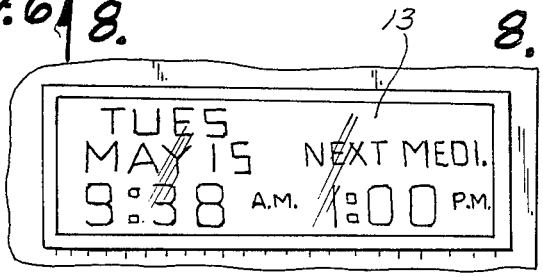
FIG. 8 is a view taken along line 8—8 of FIG. 6.

Referring now to FIGS. 5 and 6, it is noted that the pill holding dispenser (21) has a plurality of compartments (25) disposed therein and each of these compartments (25) is larger at the bottom thereof than at the top thereof. The purpose of this configuration is to prevent the pills (27) from wedging themselves into the compartment (25), especially when a plurality of such pills (27) are being utilized in each compartment (25). It is also noted in FIG. 6 that each of the openings (25) can have certain indicia thereon indicating the day and time for the medication. These spaces can also be color coded, for example with the first medication of a day being in one color, the second medication of a certain day being of another color, the third medication of a particular day being of a third color, and the fourth medication of a particular day being of a fourth color. Then for each successive day, the color coding for each particular time would be of the same color in order to aid the person in loading the device to ensure that no mistakes are made.

Figure 9:
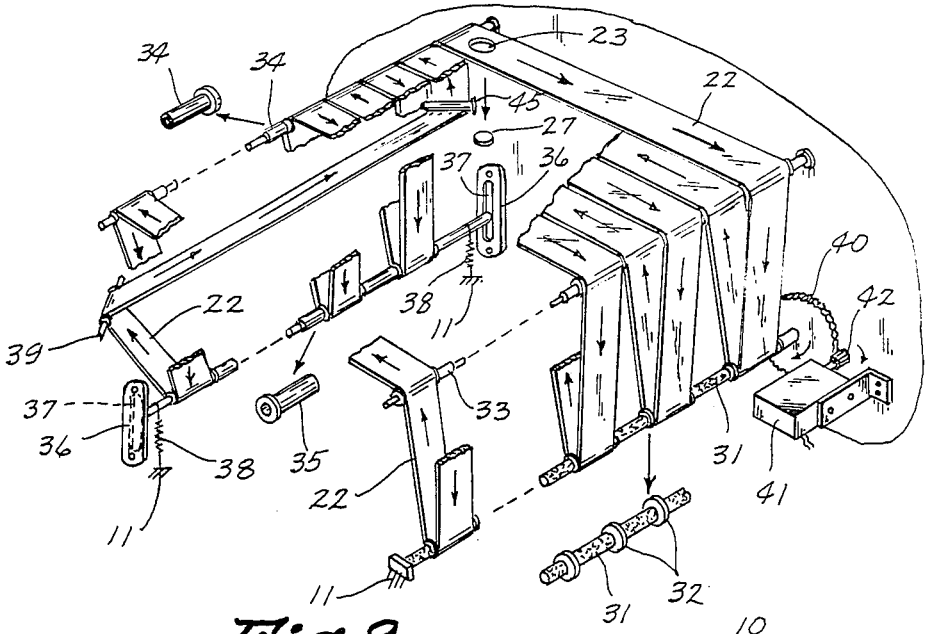
FIG. 9 is a somewhat schematic view of the belt arrangement for dispensing pills through an opening therein.

Referring now to FIG. 9, it is noted that the endless belt (22) extends around a drive spindle (31) having a roughened surface thereon and a plurality of dividers (32) for holding the belts (22) in place. The belt also extends over idler shafts (33, 34 and 35). The idler shaft (35) is mounted in a bracket (36) having a slot (37) therein on each end thereof. Tension springs (38) connect to housing (11) at the bottom thereof and to the idler shaft (35) at the top thereof for pulling the idler shaft (35) downwardly and keeping the belt (22) tight.

Figure 4:
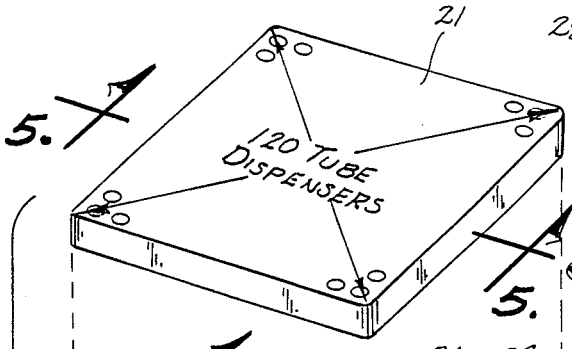
FIG. 4 is a cross sectional view taken along line 4—4 of FIG. 3.
Figure 4:
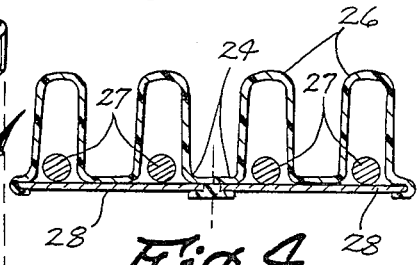
Figure 10:
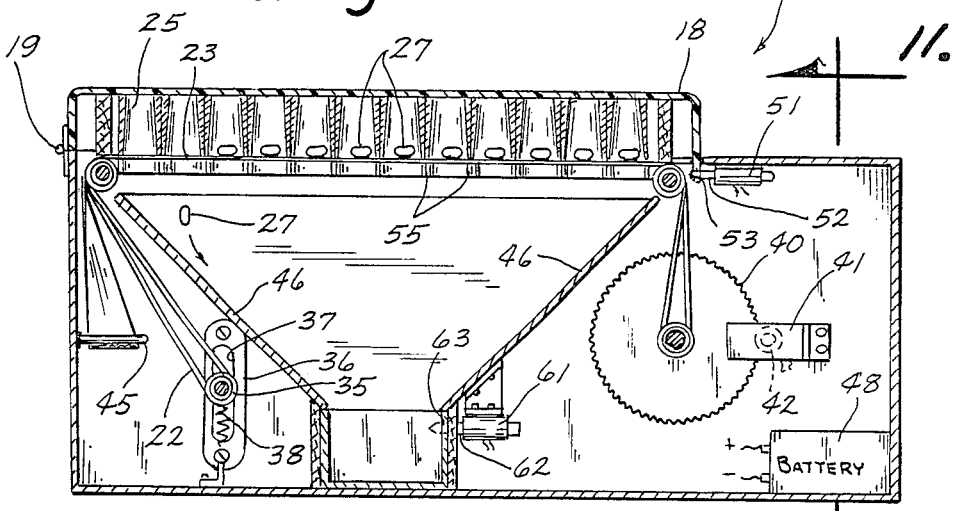
FIG. 10 is a cross sectional view taken along line 10—10 of FIG. 1.
Figure 11:
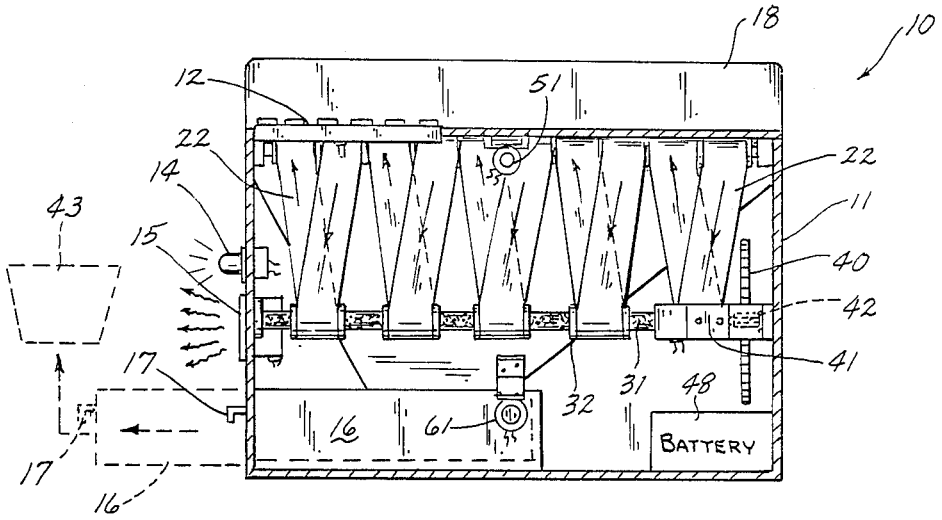
FIG. 11 is a cross sectional view taken along line 11—11 of FIG. 10.
Figure 12:
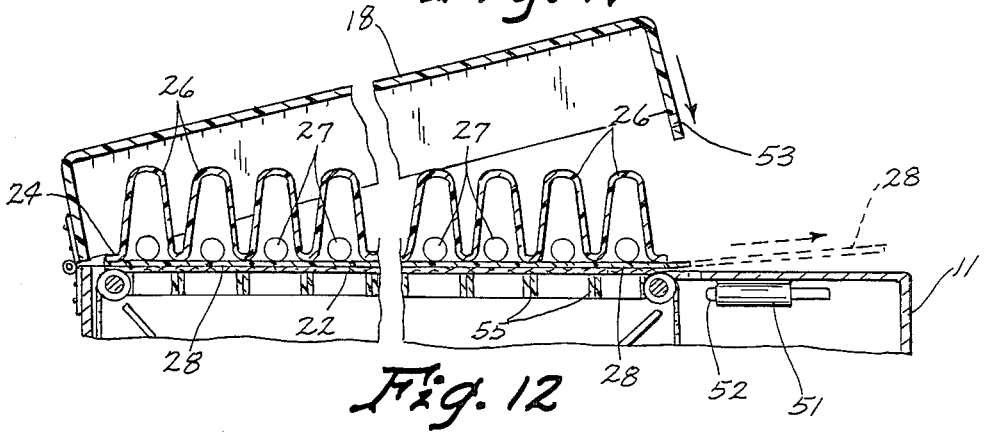
FIG. 12 is a cross sectional view taken along line 12—12 of FIG. 2 when the dispenser of FIG. 4 is being used.

Idler shafts (39 and 45) guide the belt to return it to its starting point. A drive sprocket (40) is rigidly attached to the drive shaft (31) and is driven by a motor (41) having a drive gear (42) with teeth thereon which engage the teeth in the drive gear (40). Consequently, when the motor (41) is electrically actuated, it will turn the drive gear (42) in the direction of the arrow shown in FIG. 9 which will turn the driven gear (40) also in the direction shown in the arrow in FIG. 9, thereby moving the belt (22) in the direction of the arrows. The microprocessor (12), which is shown in FIG. 6, can be programmed to operate the electric motor (41) and then to stop it in any manner which will advance the opening (23) and the belt (22) the distance between each of the compartments (25) or (26) as shown in FIGS. 4 or 5. A step motor that turns a certain amount and then shuts off automatically can also be used. For example, looking to FIG. 10, it is noted that the opening (23) has advanced to the right from the position underlying the left-most compartment (25) to a position underlying the next to the left-most compartment (25) such that the pill (27) in the compartment above the opening (23) will drop downwardly past a funnel-shaped structure (46) and into either a drawer (16) or into a cup (43) for carrying medication to patients in hospital or institutional settings within the drawer (16) as shown in FIG. 11. Preferably, the microprocessor is plugged into house AC current and has a battery back-up (48) as shown in FIGS. 10 and 11, although it could be either just battery operated or just operated using 110 AC current. Obviously, with the battery back-up (48) the system would still function dependably even if the AC power goes off, which can be a common occurrence in certain areas.

When the opening (23) in the belt (22) goes under the last pill compartment (25 or 26), (the one hundred and twentieth one in the embodiment (10) shown), the microprocessor is set to cause the motor (41) to keep turning the belt (22) until the opening (23) advances to a position just one step ahead of the position of the opening (23) shown in FIG. 2. This "reset position" of the belt can also be accomplished, for example, by entering a preset three digit code into the microprocessor (12).

A solenoid locking apparatus (51) is connected to the microprocessor (12) and has a pin (52) which extends through an opening (53) in the lid (18). A spring, not shown, within the solenoid (51) will bias the pin (52) to the position shown in FIG. 10 and then after an authorized person punches in an authorization code, for example a three-digit number known only by authorized personnel, then the microprocessor (12) will electrically actuate the solenoid (51) and pull the pin (52) out from the opening (53) and allow the lid (18) to be pivoted open to the position shown in FIG. 2. Similarly, the person who is to gain access to the medication which drops into either the tray (16) or cup (43) within the tray (16) will have an authorization code, for example of one or more digits, which will actuate a solenoid (61) which will extend into an opening (63) in the tray (16) and wherein a spring inside of a solenoid (61) will bias the pin (62) to the position shown in FIG. 10 and when the authorization code is punched into the microprocessor (12), then the solenoid (61) will be electrically actuated to pull the pin (62) out from the opening (63) and allow the tray (16) to be move to the dashed lines as shown in FIG. 11.

In operation, an authorized person would first punch an authorization code into the microprocessor (12) as shown in FIG. 6, for example by pushing in a three-digit number. Then such person would push the top unlock code as shown in FIG. 6 and this would actuate the solenoid (51) and allow the lid (18) to be pivoted open to the position shown in FIG. 2. Then the operator would decide whether prepackaged pill dispensers (24) were to be utilized or whether the tube dispenser (21) was to be utilized. Then, one or the other of such pill dispensers (21 or 24) would be placed on the belt (22) in the proper position. If the prepackaged pill dispenser (24) is utilized, then nothing further needs to be done in terms of moving pills around, but if the tube dispenser (21) is utilized, then the authorized personnel would place the proper medication in the proper openings (25) as will be understood from what has previously been discussed above in this regard. After the pill dispenser (24) is put in place, or the tube dispenser (21) has been put in place and the pills placed in it, then the lid (18) would be closed and the solenoid (51) would lock the lid (18) so as to make it tamper-proof from unauthorized persons. Then the microprocessor (12) would be utilized to program when the medication is to be dispensed and whether such medication is to be dispensed once a day, twice a day, three times a day, four times a day, in four hour intervals or as otherwise dictated by the doctor's prescription. Obviously, the microprocessor (12) can be used in many different ways which will be well understood to those skilled in this art. The time of day is set and the codes are set for authorized personnel and the start button is pushed on the microprocessor (12).

At the proper time for dispensing of medication, the light (14) will be actuated by the microprocessor so that it will flash and the alarm (15) will sound. At the same time, the solenoid plunger (61) can be programmed to unlock or it can be allowed to unlock only by knowing a certain access code known only to the person to receive the medication. If the medication dispenser (10) is around where small children are or where others might pilfer the pills, then the authorized person would want to use an authorization code rather than to have the drawer (16) freely open.

The lid (18) is designed to touch the top of the tube dispenser (21) or the top of the compartments (26) of the prepackaged pill dispenser (24) so that if the device (10) is turned upside down or shook, the pills will not fall out of the compartments of dispenser (21) or the dispenser (24) will not be moved out of its proper alignment on belt (22).

The dispensing belt (22) preferably just has one hole (48) in it, and can be driven by the motor (41) which is controlled by the microprocessor (12). As the opening moves from one compartment to the next, the pills in the compartment will drop out. The belt can be programmed to move from one compartment to the next more than one time per day, or to skip compartments for certain hours per day, or to skip days, or to dispense at different times every successive day. To illustrate, if the time is Tuesday at 6:59 a.m., as shown on the display, and the pills are to be dispensed on Tuesday at 7:00 a.m., the processor will turn the step motor (41) to move the opening (23) from under one compartment to a place directly under the next compartment, allowing the pills to tumble out of the tube and into the drawer (47) at precisely 7:00 a.m., the alarm (15) then sounds and the light (14) begins to pulsate. The drawer lock (61) would typically retract, allowing the drawer (16) to be opened for medication removal. But if there is a toddler in the house; or other persons in other settings (a hospital or old-folk's home, for example) who may attempt to pilfer the pills, the lock drawer button would be set to use an authorization code, or alternatively, a key (not shown). The authorized person then punches in a pre-entered code and the drawer will then be allowed to open to remove the pills. Once the drawer is closed, it locks. The display (13) will show the next time that a pill is to be dispensed.

Accordingly, it will be appreciated that the preferred embodiment disclosed herein does indeed accomplish all of the aforementioned objects. Obviously, many modifications and variations of the present invention are possible in light of the above teachings. For example, it may be more desirable to have several left-to-right moving belts advancing somewhat like an odometer on a car, rather than one continuous belt moving alternately from left-to-right and back then from right-to-left. This because society expects processes to advance from left-to-right, as we read, row-by-row. It is therefore to be understood that, within the scope of the appended claims, the invention may be practised otherwise than as specifically described.

I claim:

1. Apparatus for automatically dispensing medication comprising:

a housing;

a plurality of pill holding compartments each having an open bottom; wherein the plurality of pill holding compartments are arranged generally in side by side rows;

an elongated belt disposed under such pill holding compartments, said belt having at least one opening therein; wherein the elongated belt is disposed in said housing such that adjacent portions of the elongated belt are moving in opposite directions relative to one another and said side by side rows of pill holding compartments such that said at least one opening in the elongated belt will pass sequentially beneath the plurality of pill holding compartments in each row; and, means for selectively advancing said belt so that said opening moves from beneath one compartment to a position beneath another compartment whereby when said opening moves below a particular compartment, pills contained in said particular compartment will drop down through said openings.

2. The apparatus of claim 1 including lid means attached to said housing for selectively isolating said compartments from unauthorized access.

3. The apparatus of claim 2 including locking means for selectively locking the lid to the housing.

4. The apparatus of claim 3 where said locking means comprises an electrically actuated solenoid member selectively extending into or out from a hole in a portion of the lid.

5. The apparatus of claim 1 including:

a tray disposed in said housing below said compartments;

funnel means for directing pills falling from said compartments to fall into said tray;

means for permitting said tray to be removed from said housing; and means for selectively locking said tray into said housing to prevent unauthorized access to the pills in said tray.

6. The apparatus of claim 5 wherein the locking means for the tray comprises an electrically actuated solenoid.

7. The apparatus of claim 5 wherein the movement of said belt is controlled by microprocessor means for pre-programming the movement of said belt.

8. The apparatus of claim 7 wherein said microprocessor means includes means for controlling the locking means for the lid means.

9. The apparatus of claim 8 wherein said microprocessor means includes means for controlling the locking means for the tray.

10. The apparatus of claim 1 wherein said compartments are formed in a prepackaged, returnable for pharmacy refilling, bubble pack design.

11. The apparatus of claim 10 wherein said bubble pack includes a plurality of compartments with closed tops and having a removable sheet of material removably disposed thereunder.

12. The apparatus of claim 1 wherein said compartments are formed in a rigid member having a plurality of rows of compartments having open bottoms and open tops wherein said compartments can be manually filled with pills.

13. The apparatus of claim 1 wherein said compartments are larger at the bottom than at the top for preventing the pills from wedging in the compartments.

14. The apparatus of claim 13 including supporting means under said belt, said supporting means having holes therein under each of said compartments.

15. The apparatus of claim 7 wherein there are at least one hundred and twenty of said pill holding compartments and said microprocessor is programmable to dispense pills four times a day for thirty days.

16. The apparatus of claim 7 including means for permitting said microprocessor to dispense medication for up to one hundred twenty days.

17. The apparatus of claim 7 including an alarm means connected to said microprocessor means for giving a signal to the user informing the user when the pills for a particular time have been dispensed.

18. The apparatus of claim 7 including light means for giving a signal to the user informing the user when the pills for a particular time have been dispensed.

19. The apparatus of claim 7 including digital readout means connected to the microprocessor for giving the current date and time.

20. The apparatus of claim 19 wherein said digital readout means also reads out the day of the week.

21. The apparatus of claim 19 wherein said digital readout means also includes means for displaying the date and time for when the next medication will be dispensed.

22. The apparatus of claim 1 wherein said belt is endless.

* * * * *